US005467917A

United States Patent [19]

Potter

[11] Patent Number: 5,467,917

[45] Date of Patent: Nov. 21, 1995

[54] ENVELOPE

[76] Inventor: Richard Potter, 23410 Los Encinos Way, Woodland Hills, Calif. 91367

[21] Appl. No.: 247,264

[22] Filed: May 23, 1994

Related U.S. Application Data

[63] Continuation of Ser. No. 654, Jan. 5, 1993, abandoned.

[51] Int. Cl.[6] ..... B65D 27/06; B65D 27/04; B65D 27/34

[52] U.S. Cl. ..... 229/301; 229/921; 229/92.3; 229/313

[58] Field of Search ..... 229/92, 92.1, 92.3, 229/300, 305, 301, 313

[56] References Cited

U.S. PATENT DOCUMENTS

| | | | |
|---|---|---|---|
| 893,202 | 7/1908 | Shaw | 229/300 X |
| 1,583,867 | 5/1926 | Benedict | 229/92.1 |
| 2,719,734 | 10/1955 | Broudy | 229/92.1 X |
| 3,228,586 | 1/1966 | Hayes, Jr. | 229/305 |
| 3,472,444 | 10/1969 | Aliff, Jr. et al. | 229/305 X |
| 3,863,836 | 2/1975 | Austin | 229/92.1 X |
| 3,946,938 | 3/1976 | Kranz | 229/305 |
| 3,986,662 | 10/1976 | Luftig | 229/303 X |
| 4,600,141 | 7/1986 | Bradley et al. | 229/92.1 X |
| 4,898,322 | 2/1990 | Coffey et al. | 229/92.1 X |

FOREIGN PATENT DOCUMENTS

| | | | |
|---|---|---|---|
| 677739 | 7/1939 | Germany | 229/80 |
| 3058 | 8/1912 | United Kingdom | 229/302 |

*Primary Examiner*—Jes F. Pascua

*Attorney, Agent, or Firm*—McAulay Fisher Nissen Goldberg & Kiel

[57] ABSTRACT

The envelope is of generally conventional structure and carries an integral extension which may be opened prior to opening of the envelope. The extension may carry an advertising message or the like to make a high impact on a recipient. In one embodiment, the extension is of multi-panel construction and has a tab extending from one panel to secure the extension to the back ply of the envelope. In another embodiment, one panel of the extension may be secured directly to the back ply of the envelope, for example, via a fugitive glue which permits a subsequent release of the extension from the back ply for viewing purposes.

15 Claims, 3 Drawing Sheets

ENVELOPE

This is a continuation of application Ser. No. 08/000,654, filed Jan. 5, 1993, now abandoned.

This invention relates to an envelope. More particularly, this invention relates to a billing envelope containing multiple inserts including a statement and a payment envelope.

As is known, various types of envelopes have been used for the mailing of bills, statements and the like. In some cases, the envelope has been of conventional flap type with a flap which closes over a back panel to seal the contents of the envelope in a pocket formed between the back panel and a front panel. Typically, the front panel is provided with a window through which the address of the addressee can be viewed. In addition, the envelope has been stuffed not only with a statement but also with a return payment envelope and other inserts containing advertising media and order forms for merchandise. Usually, the return payment envelope is sized to receive a check, at least a return portion of the invoice and one or more of the order forms.

In other cases, it has been known to form the return payment envelope as a "bang-tail" payment envelope in which case a removable panel provided with an advertising message concerning merchandise and/or services is secured to a rear panel of the payment envelope. Such a removable panel is also provided with blank spaces to receive an address or the like, for example, for ordering the advertised merchandise or services. Generally, the removable panel can be readily removed from the payment envelope along a perforated line and then inserted into the payment envelope along with a check, money order or the like to order the indicated merchandise. Generally, the removable flap is in the form of a single panel, although in some cases, the flap is of folded over construction so that the flap can be folded out in a multi-panel array.

Billing envelopes, however, conceal the advertising messages on the payment envelopes or on the separate inserts until the point in time at which the billing envelopes are opened and the contents removed.

Accordingly, it is an object of the invention to provide a mailing envelope which has a high impact impression on a recipient.

It is another object of the invention to provide a high impact envelope for mailing invoices and order forms to customers, for example of retail stores, or banks with credit card customers.

Briefly, the invention provides an envelope which is comprised of a front ply which defines a face of the envelope, a back ply secured to the front ply to define a pocket, an extension which is integral with the back ply and which includes at least one panel carrying a message and adhesive means for securing the extension to the back ply. The adhesive means serves to secure the extension to the back ply to facilitate undamaged transmittal through the Postal Service and subsequent easy opening by the recipient. In addition, a flap extends from the front ply and is folded over the back ply and adhesive means is provided on the flap for securing the flap to the extension.

The billing envelope may also be provided with at least a return payment envelope and a statement in the pocket.

The extension may be of multi-panel construction, for example, having two panels which are folded over each other. In this embodiment, the panel which is folded under carries releasable adhesive means, for example in the form of glue dots or a line of glue, by which the extension is secured to the back panel of the envelope. In this regard, use may be made of fugitive glue spots or a line of releasable glue to permit the extension to be peeled away from the back panel of the envelope for viewing of any message on the panels.

In another embodiment, the extension may include a panel with a tab which extends therefrom and which carries adhesive means for releasably securing the tab and, thus, the extension to the back ply of the envelope. In this case, the panel which is folded under the panel with the tab includes an opening of a size complementary to the tab and aligned with the tab in order to receive the tab when the panels are in an opened-out flattened condition.

In either embodiment, the second panel may be removably attached to the first panel, for example, by means of a perforated line. In this case, the second panel can serve as an order coupon with blank spaces for receiving the name and address of an invoiced recipient/purchaser. The removable panel is also sized to fit into the payment envelope along with a check or other form of payment and mailed.

In another embodiment, the extension may be permanently sealed along one edge to the back ply of the envelope while a perforated "pullstrip" is provided in the extension to function as an opening means. In this embodiment, removal of the "pull-strip" frees the panel or panels of the extension for opening out for reading purposes.

In still another embodiment, the multi-panel extension may be formed with three panels with the outermost panel removably connected to the intermediate panel by a perforated line to be the removable mail order panel.

Typically, with the various inserts including the payment envelope inside, the flap of the envelope is folded over the extension and sealed thereto by the adhesive means on the flap in order to close the envelope. After folding over and sealing of the flap of the envelope, the envelope can be sent through the mail.

Upon receipt of the envelope, the recipient may lift the tab which secures the extension to the back panel of the envelope so as to expose the message on the covered over surfaces of the extension to view. Typically, the extension would be provided with information as well as advertising messages. The back panel of the envelope may also be provided with similar messages. The construction of the envelope is such that the extension may be folded out prior to opening of the envelope so as to encourage a spontaneous discovery and exploration of the message underneath.

After the extension has been folded out so that the message(s) on the panels can be read, the panel at the free end of the extension may be removed along the perforation or other line of weakening provided. The blank spaces on the removed panel may then provided with the name and address of a purchaser wishing to purchase merchandise or seek further information from the original addressor. At this time, the envelope may be opened to extract a return payment envelope therefrom and the now completed order form panel can then be inserted into the return payment envelope. A check, money order or other form of payment may also be enclosed with a portion of a statement in the usual manner.

With this envelope, the payment envelope may be made of relatively simple construction, for example, having a front panel and a back panel defining a pocket and a flap extending from the front panel to fold over the back panel. In addition, suitable adhesive may be provided on the flap for sealing against the back panel.

The envelope may be opened in a conventional manner. For example, a letter opener can be inserted under the regular closing flap and an opening created between the flap and the front panel of the envelope so that the contents of the envelope may be removed; or, the envelope may be opened by peeling the flap off the extension so as to expose the contents of the envelope.

These and other objects and advantages of the invention will become more apparent from the following detailed description taken in conjunction with the accompanying drawings wherein.

Figure 2:
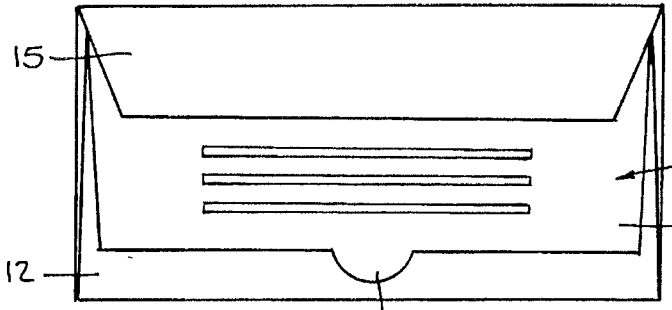
FIG. 2 illustrates a back view of the envelope of FIG. 1.
Figure 1:
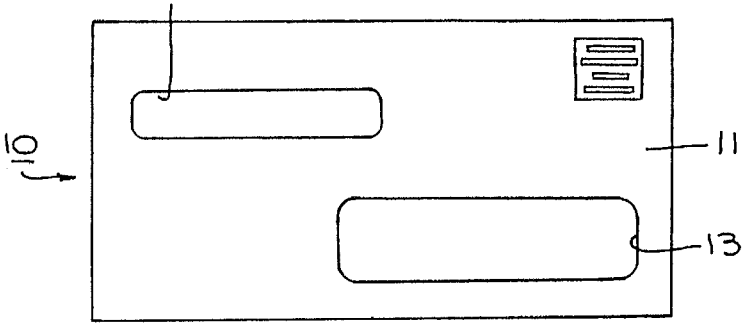
FIG. 1 illustrates a front view of an envelope constructed in accordance with the invention.

Referring to FIG. 1, the envelope 10 is constructed as a billing envelope with a front ply 11 and a back ply 12 (see FIG. 2). The front and back plies 11, 12 are made, for example, of rectangular construction and are secured to each other so as to define a pocket therebetween. In this respect, the front and back plies 11, 12 may be made from a single sheet of paper which is folded over or may be made of two separate pieces which are secured together on three sides.

In addition, as shown in FIG. 1, the front ply 11 which defines a face of the envelope is provided with a window 13 through which address information for an addressee can be viewed as well as a second window 14 through which the mailer's return address may be viewed.

Referring to FIG. 2, the envelope 10 also includes a flap 15 which extends from the front ply 11 for folding over the back ply 12. This flap 15 is provided with a suitable adhesive means 16, such as a line of glue for securement purposes.

Figure 4:
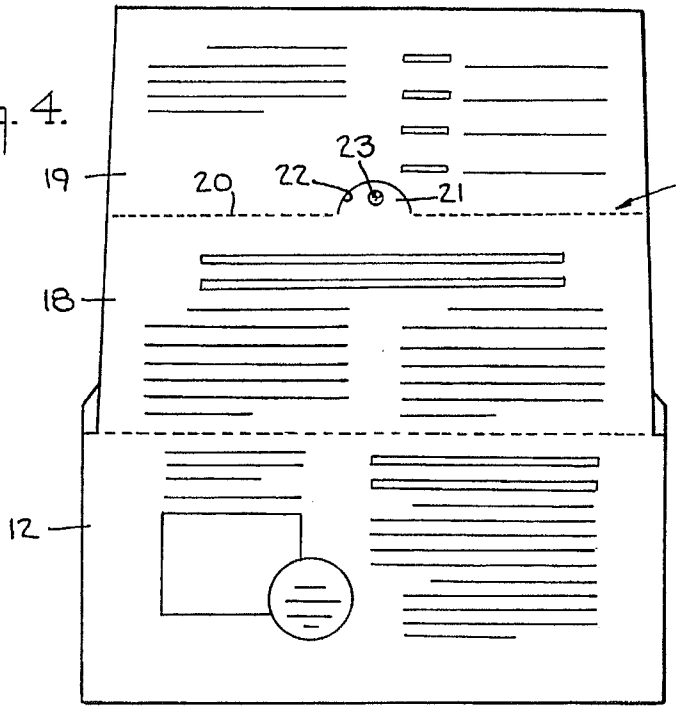
FIG. 4 illustrates the envelope with the multi-panel extension in a folded out condition for reading purposes.

Referring to FIGS. 2 and 4, the envelope 10 is also provided with a multi-panel extension 17 which is connected to the back ply 12 i.e. being integral with and which extends from back ply 12. As indicated in FIG. 4, the extension 17 has two panels 18, 19 which are separated from each by a line of weakening 20 such as a line of perforations. The panel 18 which is secured directly to the back ply 12 has an integral tab 21 which extends therefrom centrally of the panel 18. The second panel 19 is provided with an opening 22 which is the reciprocal of the tab 21 so as to receive the tab 21 when the panels 18, 19 are in an opened-out flattened condition as indicated in FIG. 4.

The tab 21 which extends from the panel 18 is also provided with adhesive means 22, such as a spot of adhesive for releasably securing the tab 21 directly to the back ply 12.

Figure 3:
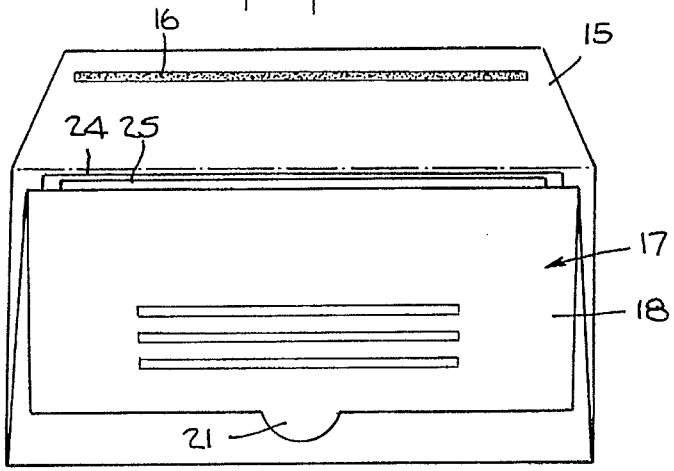
FIG. 3 illustrates a back view of the envelope of FIGS. 1 and 2 with the regular closing flap peeled away from the multi-panel extension and with the envelope's contents showing.

Referring to FIG. 3, the envelope 12 is provided with one or more inserts, for example including a statement 24 and a return payment envelope 25. Additional inserts (not shown) may carry advertising messages printed information or other messages.

The statement 24 can be prepared in a conventional fashion so as to have addressee information positioned to appear in the window 13 of the front ply 11 of the envelope 10 as well as addressor information which appears through the second window 14 of the front ply 11 of the envelope 10.

Figure 5:
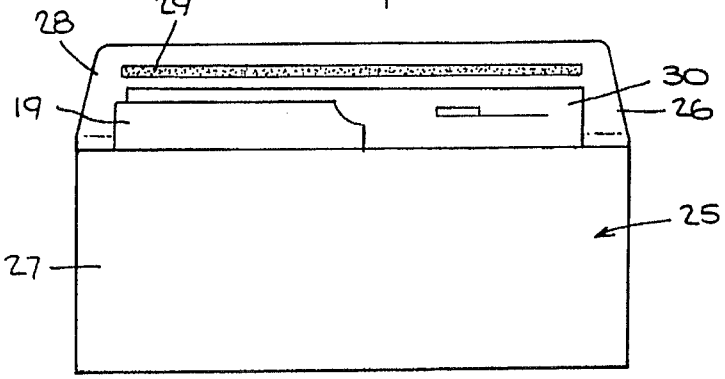
FIG. 5 illustrates a view of a payment envelope being stuffed with the removable panel of the extension and a check in accordance with the invention.

Referring to FIG. 5, the return payment envelope 25 includes a front ply 26 and a back ply 27 to form a pocket therebetween as well as a flap 28 which extends from the front ply 26 for folding over the back ply 27. A suitable line of adhesive 29 or the like is provided on the flap 28 for sealing against the back ply 27 to seal in the contents of the payment envelope 24 when required.

Referring to FIG. 2, the extension 17 which is secured to the back ply 12 of the envelope may be provided with advertising messages or the like. In this way, the recipient of the envelope, prior to opening the envelope, can be presented with a high-impact and involving message.

Further, since the extension 17 is secured directly to the back ply 12 while the envelope flap 15 is secured over the extension 17, the envelope 10 presents a flattened condition which can be readily sent through the mails as well as through automated equipment used by the postal authorities.

The billing envelope 10 presents an advertising message with sufficient space to provide a more extensive and persuasive description than previously permitted on just the back ply 12 alone. This is because the envelope construction allows several extra panels 18, 19 to be added by folding and securing these panels 18, 19 to allow their unfettered and undamaged transmittal through the Postal Service, followed by their easy opening, review and removal by the recipient after delivery. This facilitates a more adequate presentation of a product or service being offered—such completeness being critical to more fully attract the attention, arouse the interest and stimulate the desire to order of the recipient.

In addition, the panels 19 facilitate an easy response to the recipient, by providing a simple, tear-off order form, which can then be inserted in the payment envelope along with the recipient's regular statement and payment check.

The envelope 10 provides a new information and/or advertising vehicle to the sender of the billing envelope. Whereas such messages on the back ply 12, in the past, have been confined to relatively few words and/or pictures due to limited space, now more thorough and complete presentation is possible. This improves the likelihood that the recipient will find the additional material interesting, useful and actionable; which means advertisers will likely receive more inquiries and orders than has been possible before.

In addition, since the extension 17 can be opened before the flap 15, the recipient exposes the panels 18, 19 first. This means the advertiser can gain the recipient's attention and, perhaps, desire to order before the recipient opens the flap 15 to remove the regular contents, i.e. the inserts 24, 25. This early intent to order, made prior to viewing the statement 24 and discovering the amount due, will more likely result in an order than from advertising material placed inside the billing envelope and seen only after the statement 24 has been reviewed (when a recipient's mood of receptivity may have altered).

In addition, since the panels 18, 19 are folded inwards until the recipient opens them, they are better protected from damage or interference from the mail preparation, dispatch and delivery process. This means items, such as peel-off tokens, stamps, or demonstration "scent-strips" may be now included on the panels and delivered intact.

After the envelope 10 has been opened, the various inserts including the statement 24 and the return payment envelope 25 are removed. After perusing the messages on the multi-panel extension 17, the recipient can remove the outermost panel 19, for example, by tearing along the line of weakening 20. Thereafter, information regarding the ordering of merchandise can be filled in on the panel 19. Subsequently, the panel 19 can be folded on itself and placed in the pocket of the payment envelope 25 along with a check 30 and a portion of the statement 24 (not shown). The payment envelope 25 is then sealed by moistening the adhesive 29 and folding over the flap 28 onto the back ply 27 and mailed.

Referring to FIG. 1, the front ply 11 of the envelope 10 may be provided with pre-paid postage indicia thereon. Further, in an alternative embodiment, the window through which the addressor information is viewed can be omitted and the addressor information preprinted on the envelope 10.

Figure 6:
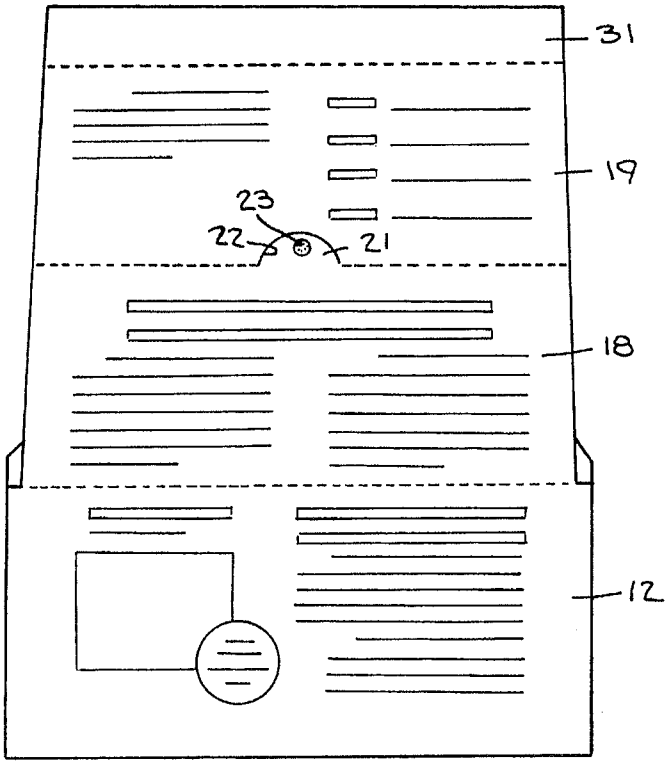
FIG. 6 illustrates a view similar to FIG. 4 of an envelope with a threepanel extension in accordance with the invention.

Referring to FIG. 6, wherein like reference characters indicate like parts as above, the envelope 10' may be provided with an extension 17' having a third panel 31. In this embodiment, the outermost panel 31 is removably connected to the intermediate panel 19 and, when in a condition as shown in FIG. 2, is folded under the intermediate panel 19. This outermost panel 31 is also sized to fit into the pocket of the return envelope 25.

While the envelope is described as containing a payment envelope, such a payment envelope is not necessary. For example, the panels of the extension may carry a request for a telephone response, such as via a toll-free number. Further, there may be no order form in the envelope construction at all. In this case, the envelope would be used for regular advertising mail.

Figure 7:
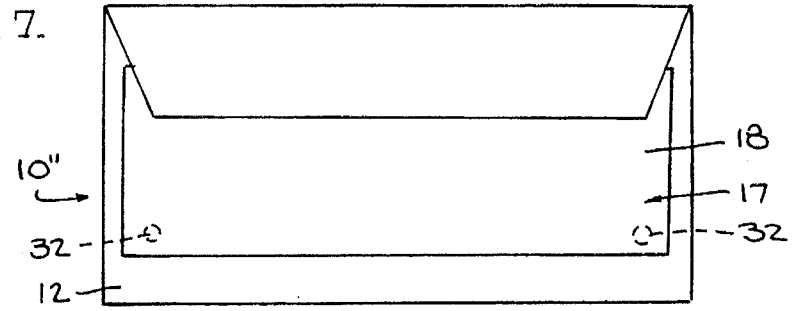
FIG. 7 illustrates a back view of an envelope employing an extension with a modified means for securing the extension to the envelope.

Referring to FIG. 7, wherein like reference characters indicate like parts as above, the extension 18 may be releasably secured to the back ply 12 of the envelope 10" by fugitive glue spots 32 or by a line of glue (not shown).

Figure 8:
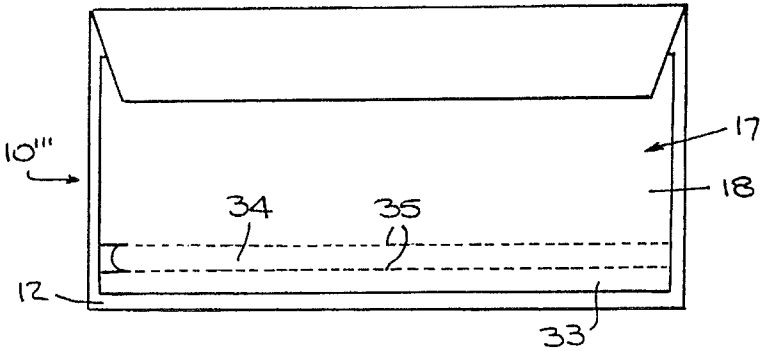
FIG. 8 illustrates a back view of an envelope employing an extension with a pull-strip in accordance with the invention.

Referring to FIG. 8, wherein like reference characters indicate like parts as above, the extension 17 may be of single panel construction with a strip 33 permanently secured to the back ply 12 while a pull-strip 34 is interposed between the strip 33 and the remainder of the panel 18 of the extension 18. As indicated, the pull-strip 34 is defined between a pair of parallel perforated lines 35 so as to be readily removed from the panel 17 when desired. Upon removal, the panel 18 is free to be folded upwardly, as viewed.

Figure 9:
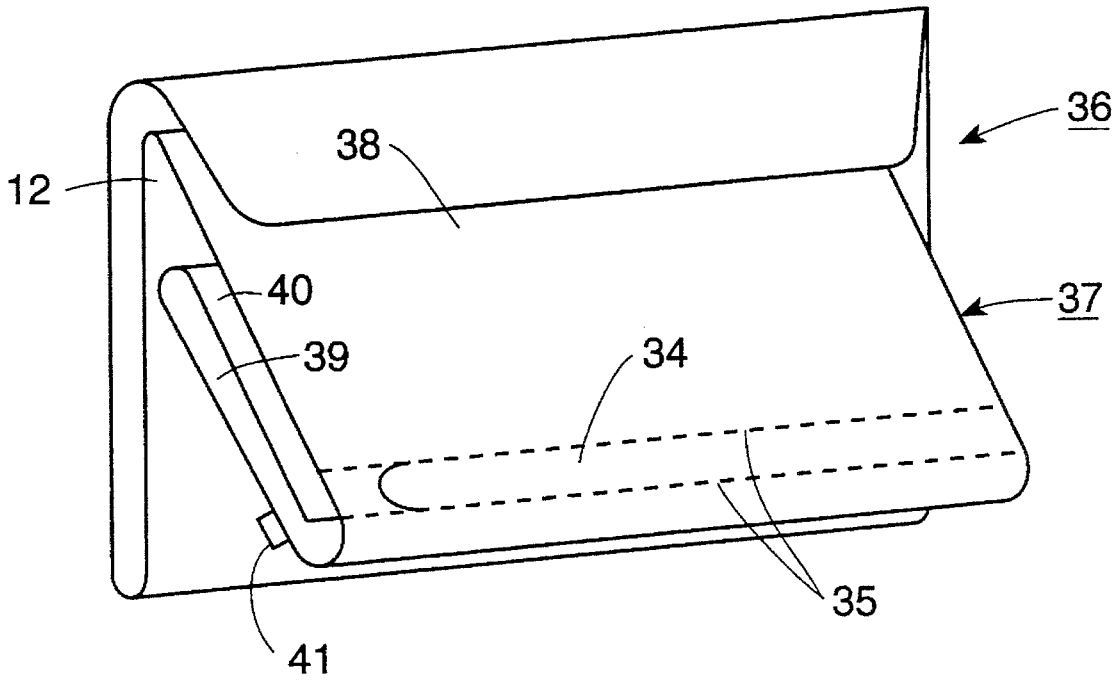
FIG. 9 illustrates a perspective view of a modified envelope employing a multi-panel extension with a pull-strip in accordance with the invention.

Referring to FIG. 9, wherein like reference characters indicate like parts as above, the envelope 36 may have a multi-panel extension 37 which employs a pull strip 34. As indicated, the extension 37 has three panels 38, 39, 40. A first panel 38 is secured to a back ply 12 as above. The second panel 39 is connected to the first panel 38 and faces the back ply 12 with adhesive means 41, such as a line of glue, securing the panel 39 to the back ply 12. The third panel 40 is connected to the second panel 39 and is folded over to be disposed between the first and second panels 38, 39.

The pull strip 34 is formed in the first panel 38 between a pair of parallel perforated lines 35 so as to be readily removed from the panel 38. Upon removal of the pull-strip 34, at least a portion of the panel 38 is separated from the second panel 39 to permit exposure of an inside surface of the panel 38 for viewing of a message thereon.

The third panel 40 is also separated from the second panel 39 by a line of weakening such as a perforated line (not shown), so as to be readily removed after the pull-strip 34 has been removed and used as an order form.

The invention thus provides an envelope which can be readily passed through the mails while carrying advertising message to provide a highimpact impression on a recipient.

The invention also provides an advertiser with a billing envelope which presents a full and complete sales presentation of a product or service of interest to the recipient, even before the recipient has opened the billing envelope. This allows advertisers to reach active, credit-worthy customers on a regular, monthly basis (along with the monthly statement) and as part of a vehicle (the billing envelope) which will not be discarded as "advertising mail" but which will certainly be kept and opened by the recipient. This insures the advertiser of 100% penetration of his/her target market. The envelope also facilitates a convenient order, since the recipient must return the payment envelope with the statement and check inside. While doing that, the recipient need only include the order form (from panel 19 or 31) to accept the advertiser's offer. Alternatively, the envelope may be used without a return payment envelope, for example where the order form of the extension carries a request for a telephone response (via toll-free number) or at least, as an alternate response. Still further, the envelope may be used for "regular" advertising mail, there may be no order form in the envelope at all.

Although the extension is described for use with a billing envelope, the extension could also be used with a conventional mailing envelope—most likely advertising, for example, for companies sending non-sales information through the mail. Sometimes a company wants the recipient to see a message before opening the main envelope. This message may be a money-back guarantee to minimize the "risk" a recipient might perceive in ordering or a statement concerning a deadline for responding.

What is claimed is:

1. An envelope comprising a front ply defining a face of the envelope;

a back ply secured directly to said front ply along a common transverse edge to define a pocket therewith;

an extension integral with said back ply, said extension including a first panel connected to and extending from said back ply and a second panel connected to and folded under said first panel;

first adhesive means securing said extension directly to said back ply; and said first panel having at least one tab extending therefrom with said first adhesive means thereon and said second panel includes an opening of a size reciprocal to said tab and aligned with said tab to receive said tab with said panels in an opened-out flattened condition.

2. An envelope as set forth in claim 1 further comprising a flap extending from said front ply and folded over said back ply and said extension; and second adhesive means on said flap securing said flap to said extension.

3. An envelope as set forth in claim 1 which further comprises at least a payment envelope in said pocket and wherein said second panel is removably connected to said first panel for removal therefrom, said second panel being sized to fit into said payment envelope.

4. An envelope as set forth in claim 1 wherein said extension includes a third panel removably connected to and folded under said second panel.

5. An envelope as set forth in claim 1 wherein said front ply has a first window for displaying addresser information therethrough.

6. An envelope as set forth in claim 1 wherein said adhesive means includes a plurality of fugitive glue spots releasably securing said extension to said back ply.

7. An envelope comprising a front ply defining a face of the envelope;

a back ply secured directly to said front ply to define a pocket therewith;

an extension integral with said back ply, said extension including at least a first panel connected to and extending from said back ply, a second panel connected to said first panel and facing said back ply and a third panel connected to said second panel and disposed between said first and second panels; and adhesive means between said second panel and said back ply securing said extension directly to said back ply.

8. An envelope as set forth in claim 7 wherein said first panel of said extension includes a removable pull-strip for separating at least a portion of said first panel from said second panel upon removal thereof to permit exposure of an inside surface of said first panel for viewing.

9. An envelope comprising a front ply defining a face of an envelope having pre-paid postage indicia thereon;

a back ply secured to said front ply to define a first pocket therewith;

a flap extending from said front ply over said back ply;

a multi-ply extension connected to said back ply, said extension including a first panel integral with said back ply and having a centrally disposed tab extending therefrom, at least a second panel connected to and folded under said first panel in facing relation to said back ply, and adhesive means on said tab releasably securing said tab and said extension to said back ply; and adhesive means on said flap securing said flap to said first panel of said extension.

10. An envelope construction as set forth in claim 9 wherein said extension, includes a third panel connected to and folded under said second panel.

11. An envelope construction as set forth in claim 10 wherein said third panel is removably connected to said second panel for removal therefrom.

12. An envelope construction as set forth in claim 9 wherein said second panel includes an opening of a size complementary to said tab and aligned with said tab to receive said tab with said panels in an opened-out flattened condition.

13. An envelope construction as set forth in claim 9 wherein said second panel is removably secured to said first panel and carries blank spaces to receive address information for mail-ordering.

14. An envelope construction as set forth in claim 13 further comprising at least a payment envelope in said pocket for receiving said second panel.

15. An envelope comprising a front ply defining a face of the envelope;

a back ply secured directly to said front ply along a common transverse edge to define a pocket therewith;

an extension integral with said back ply, said extension including at least a first panel connected to and extending from said back ply, a strip and a removable pull-strip adjacent said strip; and adhesive means on said strip securing said extension directly to said back ply.

* * * * *